US006370722B1

(12) United States Patent
Duckworth

(10) Patent No.: US 6,370,722 B1
(45) Date of Patent: Apr. 16, 2002

(54) WALL MOUNTED BACK-SCRUBBING AND MASSAGING APPARATUS

(76) Inventor: David Duckworth, 2027 St. Augusta La., Hawthorne, CA (US) 90250

( * ) Notice: Subject to any disclaimer, the term of this patent is extended or adjusted under 35 U.S.C. 154(b) by 105 days.

(21) Appl. No.: 09/639,465

(22) Filed: Aug. 15, 2000

(51) Int. Cl.[7] ..... A47K 7/03

(52) U.S. Cl. ..... 15/104.92; 15/160; 15/210.1; 15/244.1; 15/244.3; 4/606; 601/136; 248/205.5; 248/206.3; 248/206.4

(58) Field of Search ..... 15/104.92, 160, 15/210.1, 244.1, 244.3; 4/606; 601/136; 248/683, 205.5–205.8, 206.1–206.4

(56) References Cited

U.S. PATENT DOCUMENTS

| | | | | | |
|---|---|---|---|---|---|
| 1,639,366 | A | * | 8/1927 | Brown | 15/160 X |
| 2,389,215 | A | | 11/1945 | Singleton | 585/380 |
| 2,901,760 | A | * | 9/1959 | Nelson | 15/160 |
| 3,040,337 | A | * | 6/1962 | Fjelstad | 15/160 X |
| 3,289,215 | A | * | 12/1966 | Kennedy | 4/606 |
| 3,478,369 | A | * | 11/1969 | Ensley | 4/606 |
| 3,577,985 | A | * | 5/1971 | Griffin | 4/606 X |
| 3,612,044 | A | * | 10/1971 | Gurrola | 601/136 |
| 3,631,560 | A | | 1/1972 | Atkins | 15/146 |
| 3,750,226 | A | | 8/1973 | Morgan | 15/187 |
| 4,020,519 | A | | 5/1977 | Robison | 15/104.92 |
| 4,047,259 | A | | 9/1977 | Lotis | 15/104.92 |
| 4,053,960 | A | * | 10/1977 | Kingswell | 15/104.92 |
| 4,417,362 | A | * | 11/1983 | Walker | 4/606 |
| 4,420,850 | A | * | 12/1983 | Moore | 4/606 X |
| 4,696,068 | A | | 9/1987 | Kenner | 4/606 |
| 4,699,127 | A | | 10/1987 | Schley | 601/136 |
| 4,890,352 | A | | 1/1990 | Stowers et al. | 15/244.1 |
| 5,179,755 | A | | 1/1993 | Hill, Jr. | 15/160 |
| 5,277,389 | A | | 1/1994 | Ballares et al. | 248/206.3 |
| 5,311,635 | A | | 5/1994 | Moore | 15/244.3 |
| 5,312,666 | A | * | 5/1994 | Jovanovic | 4/606 X |
| 5,345,640 | A | * | 9/1994 | Goss | 4/606 X |
| 5,490,302 | A | | 2/1996 | Dion | 15/210.1 |
| 5,517,705 | A | * | 5/1996 | Jackson | 4/606 |
| 5,600,864 | A | | 2/1997 | Huber | 15/118 |
| 5,628,083 | A | | 5/1997 | Hayes | 15/244.3 |
| 5,784,722 | A | * | 7/1998 | Ureta et al. | 15/244.1 |
| 5,822,824 | A | * | 10/1998 | Dion | 15/210.1 |
| 5,836,035 | A | * | 11/1998 | McElfish et al. | 15/160 |

FOREIGN PATENT DOCUMENTS

| | | | | |
|---|---|---|---|---|
| GB | 2123281 | * | 2/1984 | 15/160 |
| GB | 2209933 | * | 6/1989 | 15/210.1 |
| GB | 2278052 | * | 11/1994 | 15/244.1 |
| WO | 79/00865 | * | 11/1979 | 601/36 |

* cited by examiner

*Primary Examiner*—Mark Spisich
(74) *Attorney, Agent, or Firm*—Gene Scott-Patent Law & Venture Group

(57) ABSTRACT

A wall mounted back-scrubbing and massaging apparatus has a wall mounting plate which is bonded to a rubber sheet having a plurality of suction cups, thereby allowing the wall mounting plate to be removably attachable to a wall surface. A sponge mounting box is mounted on the wall mounting plate by a lip. Opposite the lip, the sponge mounting box provides a base and a peripheral edge, which together form a sponge mounting surface. In a first embodiment, the base and the peripheral edge removably engage a sponge. A plurality of outwardly extending fingers integral with the base, penetrate the sponge, further securing the sponge onto the base. The sponge is thus supported in spaced relationship with respect to the wall surface by the sponge mounting box so as to be in a position for convenient scrubbing of a person's skin when brought into contact with the sponge. In a second embodiment, the mounting box further includes a cover which frictionally engages the sponge mounting box, clamping a flexible lateral apron portion of a rectangular cloth, holding the cloth over the base. The cover and the sponge mounting box further provide drain apertures to allow water to drain from the apparatus.

15 Claims, 5 Drawing Sheets

12
3
32
10
30
40
34
60
60A
36
66
20
3

26
22
24
20
42
56A
30
50
28
60A
34
36
56
54
60
62

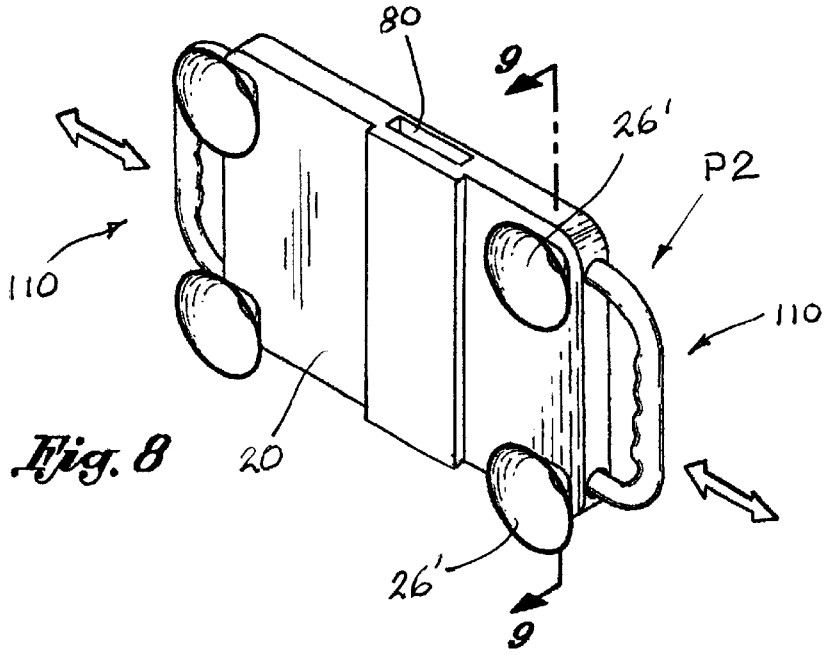
Fig. 8
Fig. 9
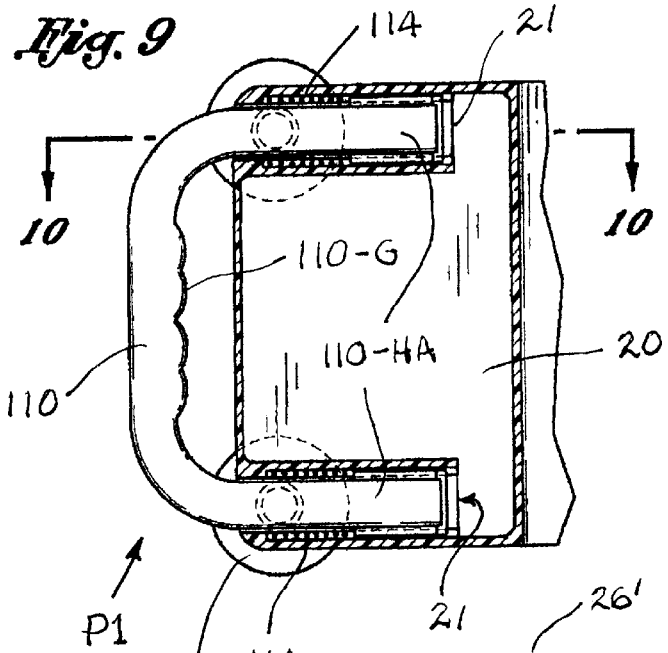
Fig. 10
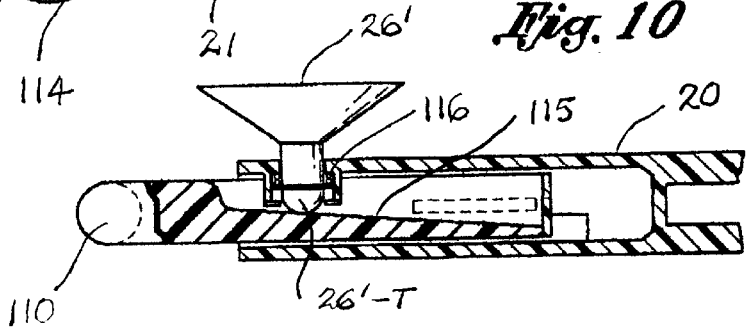

WALL MOUNTED BACK-SCRUBBING AND MASSAGING APPARATUS

BACKGROUND OF THE INVENTION

1. Field of the Invention

This invention relates generally to personal cleaning devices; and more particularly to an improved wall mounted back-scrubbing and massaging apparatus.

2. Description of Related Art

The following art defines the present state of this field:

Kennedy, U.S. Pat. No. 2,389,215 describes an invention relating to a unit adapted to be used for the cleaning of a person's back. The invention has a disposable cleaning unit particularly adapted to be used in a shower stall of a motel, hotel, or the like. The device includes a broad sponge surface that is preferably shaped to conform to the curvature of a person's back and also includes a means to suitably mount the cleaning means in a vertical position on the wall of a shower. The disposable cleaning unit includes a support member preferably composed of a plastic material, such as polystyrene, to which is suitably secured a layer of plastic foam material which is adapted to receive a water and soap solution. The cleaning unit may be secured to the wall of the shower by a pair of opposed channel members which removably receive opposing edge portions of the support member. The cleaning unit may be supported by the channel members at a height to provide an optimum height above the floor of the shower stall for a user.

Atkins, U.S. Pat. No. 3,631,560 describes a brush and holding device for mounting on a wall of a bathtub or shower, the holding device comprising a back section and a plurality of tabs spaced from said back section and defining therewith retaining areas. The brush includes a body portion dimensioned to be removably received by said retaining areas, the bristles of said brush extending substantially beyond said tabs so as to present a continuous bristle surface for contact by the user.

Morgan, U.S. Pat. No. 3,750,226 describes a T-shaped cleaning and massaging device adapted for mounting on the walls of a shower stall for cleaning and massaging a user's back.

Robison, U.S. Pat. No. 4,020,519 describes a body scrubbing apparatus such as a stationary back scrubber is disclosed for attachment to a wall which comprises a resilient sponge device having a reservoir at the top there of for gravity feeding liquid detergent from the reservoir to the bottom of the porous member of sponge. In one embodiment a sponge having a gradient density increasing from the reservoir downwardly toward the bottom of the porous member or a sponge is provided to minimize pooling or collection of liquid detergent at the bottom of the sponge or porous member.

Lotis, U.S. Pat. No. 4,047,259 describes this disclosure pertains to a flexible rubber-like mat having a plurality of suction cups affixed to one lateral surface thereof. The other lateral surface is substantially covered with a loose pile fabric-like material adapted to be releasing engaged by one surface of a flexible soap containing apparatus. The plastic gripping surface of the flexible soap container is adapted with a multiplicity of multi-directional material grasping fingers. The remainder of the container is fabricated from porous sponge-like material enabling the soap within to be fluidly communicated with the exterior porous surfaces of the container. The mat may be installed on a wall or on the interior surfaces of a bathtub providing a convenient storage location for the soap container and utility as a washing aid.

Kenner, U.S. Pat. No. 4,696,068 describes a back washer and massager supported on a shower wall. The invention includes a pad of foam plastic with a waterproof cover and a rigid backing plate supported by a plurality of suction cups with a terry cloth or similar fabric cover mounted on the pad. The invention enables easy removal for laundering. The cover for the pad includes a pocket on the interior surface thereof to receive soap positioned in a net bag so that a person taking a shower or bath can position their back or any other inaccessible area of their body against the surface of the terry cloth or other fabric cover and by moving the body area engaged with the cover provide a washing or massaging function on the surface area of the body.

Stowers et. al., U.S. Pat. No. 4,890,352 describes a back washer is provided and consists of a sponge rubber washing member affixed to a flat flexible rubber base plate that is removably mounted to a flat surface so that a person can wash their back against the washing member when in shower and bathtub.

Hill, Jr., U.S. Pat. No. 5,179,755 describes a pliable, waterproof mat has a rough, fibrous surface and a woven backing. A fabric tape extends about the mat perimeter which, along with stitching, serves to hold fabric closure pieces in place on the mat backing. Wall surface attachment, either to a room wall or a bathtub wall, is accomplished by the use of adhesively backed fabric closure pieces of either strip or patch shape with the latter used for temporary installation. A waterproof container permits packing of a damp mat in a suitcase.

Ballares et al., U.S. Pat. No. 5,277,389 describes a back scrubber to be used in the shower includes a holder which is ordinarily adhered to the shower wall by suction cups and which has a releasable and reversible sponge thereon which can be quickly replaced or used without removing the holder from the wall.

Moore, U.S. Pat. No. 5,311,635 describes a back cleaning apparatus which is adapted to be mounted in either a shower or bathtub. The apparatus includes suction cups for removably attaching it to the wall of a shower or bathtub. The cleaning surface comprises a sponge rubber member provided with a cover member such as indoor-outdoor carpet.

Dion, U.S. Pat. No. 5,490,302 describes a wall mounted back washer and applicator which may be used to wash, massage, or to apply lotion or salve to the back of the human torso without assistance. The device includes a foam pad mounted to a rigid plate which contains a plurality of suction cups for demountably attaching to any wall surface. In the alternative, the foam pad may be replaced by or used in conjunction with an inflatable bladder 40 which is inflated or deflated according to the user's desires for a rougher or softer application surface. The size of the device accommodates for the use of any standard size wash cloth. Fabric of equal or larger size and thickness can be used with the device.

Huber, U.S. Pat. No. 5,600,864 describes a back scrubber includes a reversible cleaning pad having two sides. Each side has a different type of cleaning surface. There is a mechanism for selectively and releasably connecting the pad to a wall of a shower stall so that either side can face outwardly. The mechanism may include suction cups. The suction cups may be on both sides of the pad.

Hayes, U.S. Pat. No. 5,628,083 describes a device to clean or apply a balm to a person's back includes a rigid base panel fastened to a wall with suction cups on a shower wall. The device includes a foam panel covered PVC sheet which in turn is covered with a plastic netting to reduce the sliding friction with an overall cover. The device may include a spinal scrubber between the cover and the netting of vertical row of semi-rigid block members attached to a panel all encased in foam and sealed film. Foam balm applicators may be attached on the cover either in netting pockets or with cotton balls attached on the foam applicators.

The prior art teaches various devices which assist in cleaning or massaging a person's back while taking a shower. However, the prior art does not teach a device that is easy to mount on a shower wall, provides a suitable structure for rubbing and massaging one's back while in the shower, and also provides for easy interchangeability of scrubbing and massaging materials, either to provide different textures or for laundering the scrubbing and massaging materials. The present invention fulfills these needs and provides further related advantages as described in the following summary.

SUMMARY OF THE INVENTION

The present invention teaches certain benefits in construction and use which give rise to the objectives described below.

The present invention provides a wall mounted back-scrubbing and massaging apparatus having a wall mounting plate which is removably attachable to a wall surface with a suction cup means. A scrubbing means mounting box is mounted onto the wall mounting plate and a scrubbing means, preferably a sponge, is removably attached to a scrubbing means mounting surface on the mounting box. A plurality of outwardly extending fingers is integral with the mounting box penetrate the sponge, further securing the sponge onto position. The sponge is thus supported in spaced relationship with respect to the wall surface by the scrubbing means mounting box so as to be in a position for convenient scrubbing of a person's skin when brought into contact with the sponge. In a second embodiment, the mounting box provides an angled outer surface. The apparatus further includes a cover having a cover sidewall corresponding to the angled outer surface. The cover frictionally engages the angled outer surface clamping a flexible lateral apron portion of the scrubbing means. The cover and the mounting box provide a drain means for enabling water passage and drainage. The cover preferably further includes a pair of handles so the user may more firmly grasp the cover for mounting and dismounting it. In a further embodiment of the invention a means for adjusting the vertical height of the apparatus is taught so as to enable the device to be conveniently used with both tall and shorter individuals. A means is also taught for positively engaging a larger set of suction cups of the wall attachment means of the invention and for releasing them in conjunction with a set of laterally mounted handles.

A primary objective of the present invention is to provide a wall mounted back-scrubbing and massaging apparatus having advantages not taught by the prior art.

Another objective is to provide a back-scrubbing and massaging apparatus which supports a scrubbing means in spaced relationship with respect to the wall surface so as to be in a position for convenient scrubbing of a person's skin.

Another objective is to provide a back-scrubbing and massaging apparatus having a scrubbing means which can quickly and easily be changed, either to provide a scrubbing means with a different texture or to launder the scrubbing means.

A further objective is to provide a back-scrubbing and massaging apparatus which holds a reservoir of soap, the reservoir being easily refillable to maintain a steady supply of soap to the scrubbing means.

A still further objective is to provide such a back scrubbing apparatus having the ability for easily raising and lowering the device on the wall to which it is attached.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 8 is a perspective view of a bottom portion of the base plate thereof shown without a plurality of smaller suction cups;

FIG. 9 is a sectional view taken along line 9—9 in FIG. 8 showing the interior of the base plate and details of engagement of a handle means; and FIG. 10 is a sectional view taken along line 10—10 in FIG. 9 showing further details of the handle means and its relationship with the suction cups.

DETAILED DESCRIPTION OF THE INVENTION

Figure 1:
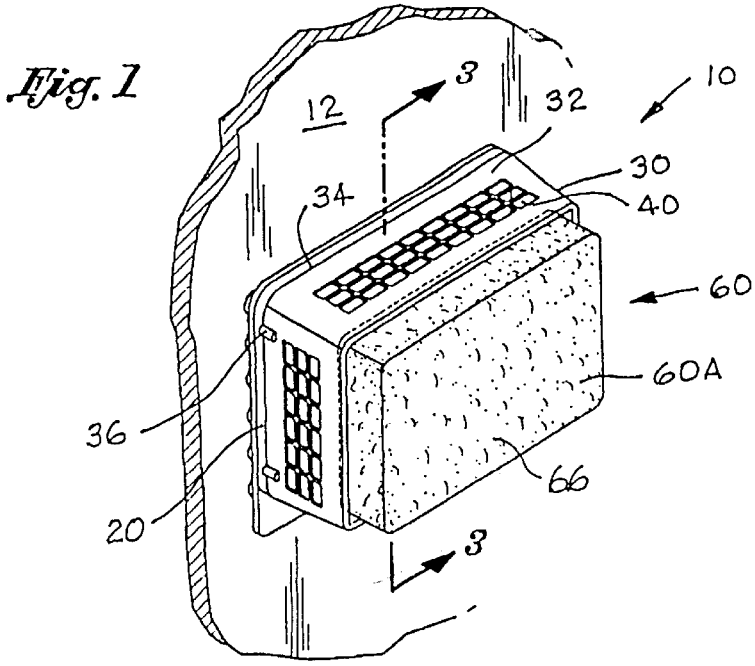
FIG. 1 is a perspective view of a first embodiment of the present invention.
Figure 2:
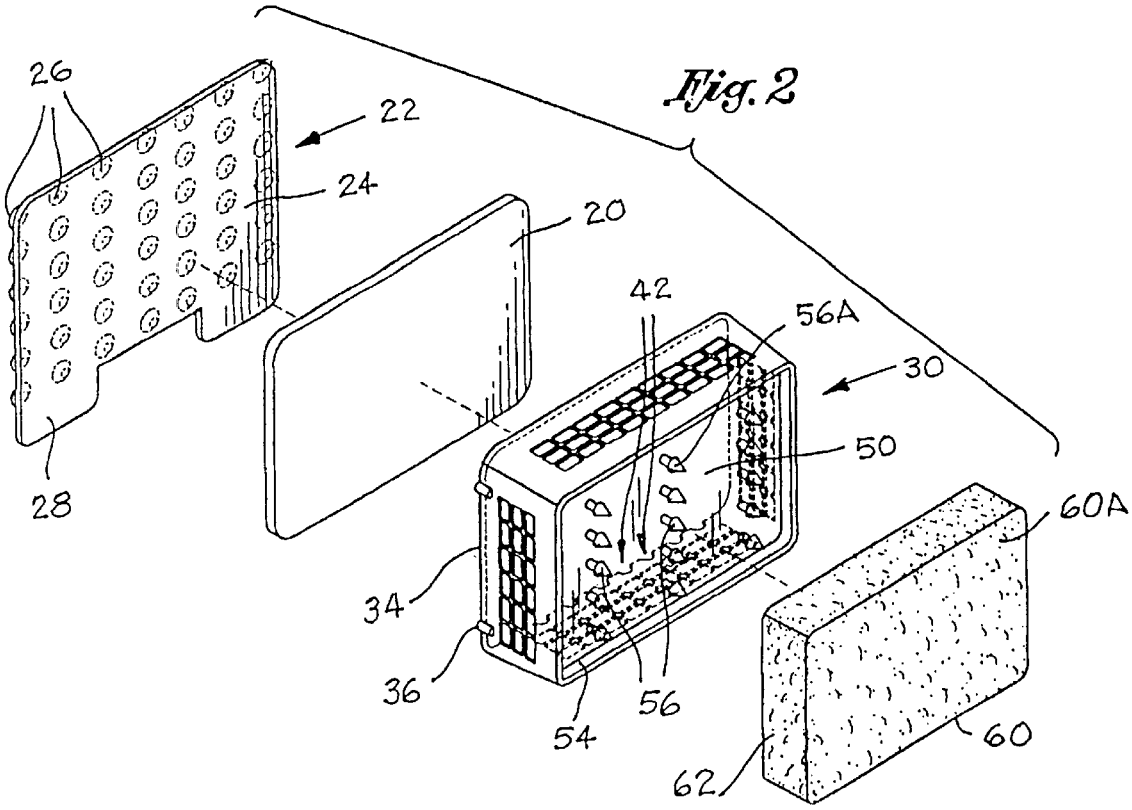
FIG. 2 is a perspective exploded view thereof.
Figure 3:
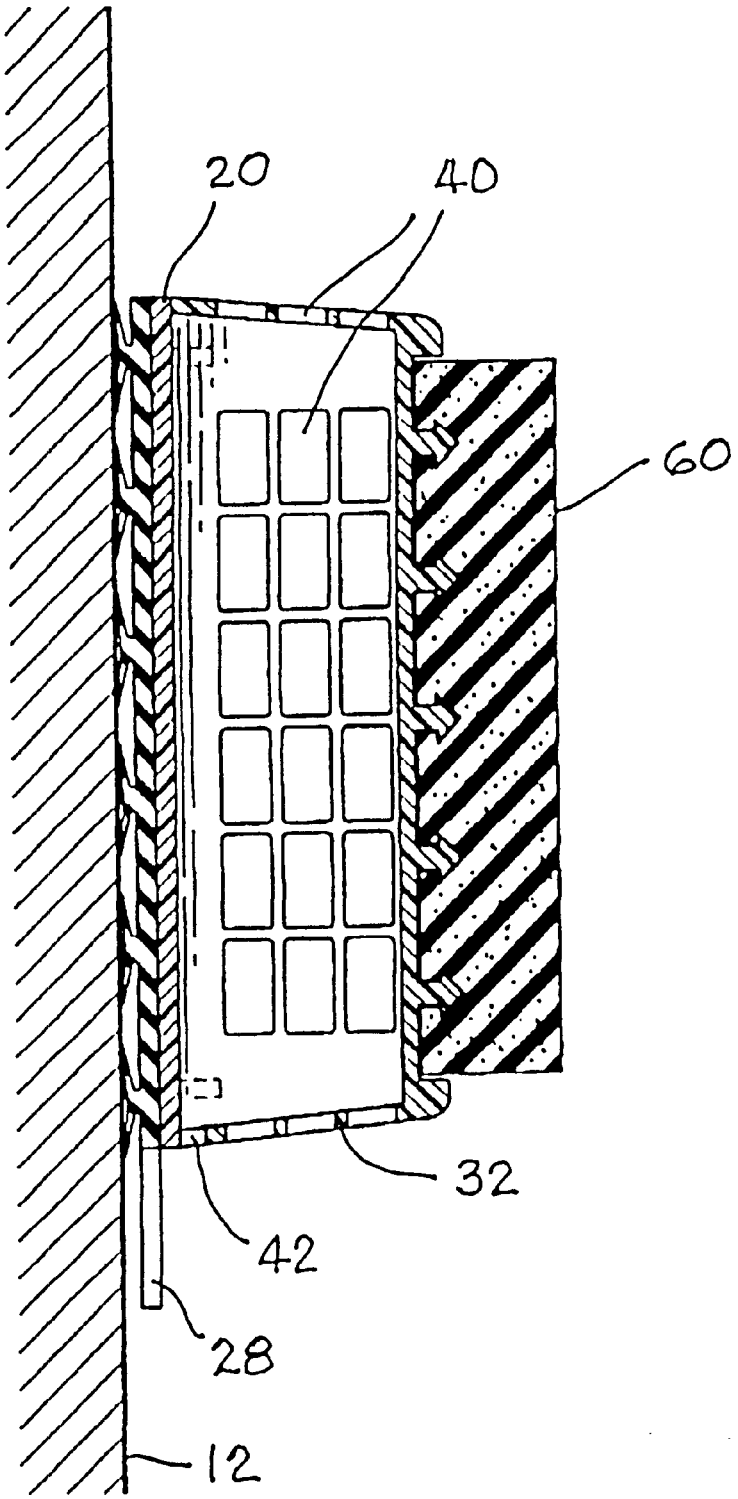
FIG. 3 is a sectional view thereof taken along line 3—3 in FIG. 1.

The above described drawing figures illustrate the invention, a wall mounted back-scrubbing and massaging apparatus 10. As shown in FIGS. 1–3, the apparatus 10 includes a wall mounting plate 20 providing a means for removably securing 22 the wall mounting plate 20 to a wall surface 12. The wall mounting plate 20 is preferably a rigid plastic or rubber plate approximately 10 inches wide, 12 inches long, and ¼ inch thick although the size of this part is dependent upon the selection and convenience of those using the invention. The means for removably securing the wall mounting plate 20 to the wall surface 12 is preferably a suction cup means. The securing means 22 preferably provides a flexible rubber sheet 24 having a plurality of suction cups 26 integrally formed on one side of the rubber sheet 24 opposite the wall mounting plate 20. Other equivalent means include, but are not limited to, hook and loop fastener materials bonded to both the wall mounting plate 20 and the wall surface 12; and a bracket bonded to the wall surface 12, the bracket capable of removably engaging the wall mounting plate 20. Structures disclosed in the patents discussed herein in the Description of the Related Art are expressly thought to be equivalent to the described means. The flexible rubber sheet 24 is preferably approximately the same size as the wall mounting plate 20. The flexible rubber sheet 24 is preferably bonded to the wall mounting plate 20 with an adhesive, although many methods can be used to join the two elements. The suction cup means 22 preferably provides a tab means 28 extending laterally from the flexible rubber sheet 24. The tab means 28 is preferably a tab or a pair of tabs. Each tab 28 is located in a position for grasping the tab 28 for defeating the plurality of suction cups 26 by pulling the tab 28 away from the wall surface 12. The tab 28 is preferably located on the bottom of the flexible rubber sheet 24. In an alternative embodiment, the rubber sheet itself is the wall mounting plate and there is no rigid plastic plate bonded to the rubber sheet. In yet another alternative embodiment, there is no rubber sheet and the suction cups, or other means for removably securing, are directly attached to a rigid plastic wall mounting plate. The preferred embodiment, as shown in FIG. 2, has both a flexible rubber sheet 24 and a rigid plastic wall mounting plate 20 because this configuration has proven to be the best mode of practicing the invention.

The apparatus 10 further includes a scrubbing means mounting box 30. The mounting box 30 provides a lip 34 and a scrubbing means mounting surface 50. In its preferred embodiment, the mounting box 30 is a plastic box having a mounting box supporting sidewall 32 and a base 52. The lip 34 is formed by the edge of the mounting box supporting sidewall 32 opposite the base 52. The lip 34 is designed to fix the mounting box 30 onto the wall mounting plate 20. The lip 34 preferably includes a plurality of screw bosses 36 for mounting the scrubbing means mounting box 30 to the wall mounting plate 20. In another embodiment, the lip 34 is thermally welded to the wall mounting plate 20. In yet another embodiment, the lip 34 and the wall mounting plate 20 are each bonded to hooks and loops, allowing the wall mounting plate 20 to be removably engaged to the lip 34. Many other methods of joining the lip 34 of the plastic box to the wall mounting plate 20 are within the scope of this invention and equivalent to those specifically enumerated.

Figure 4:
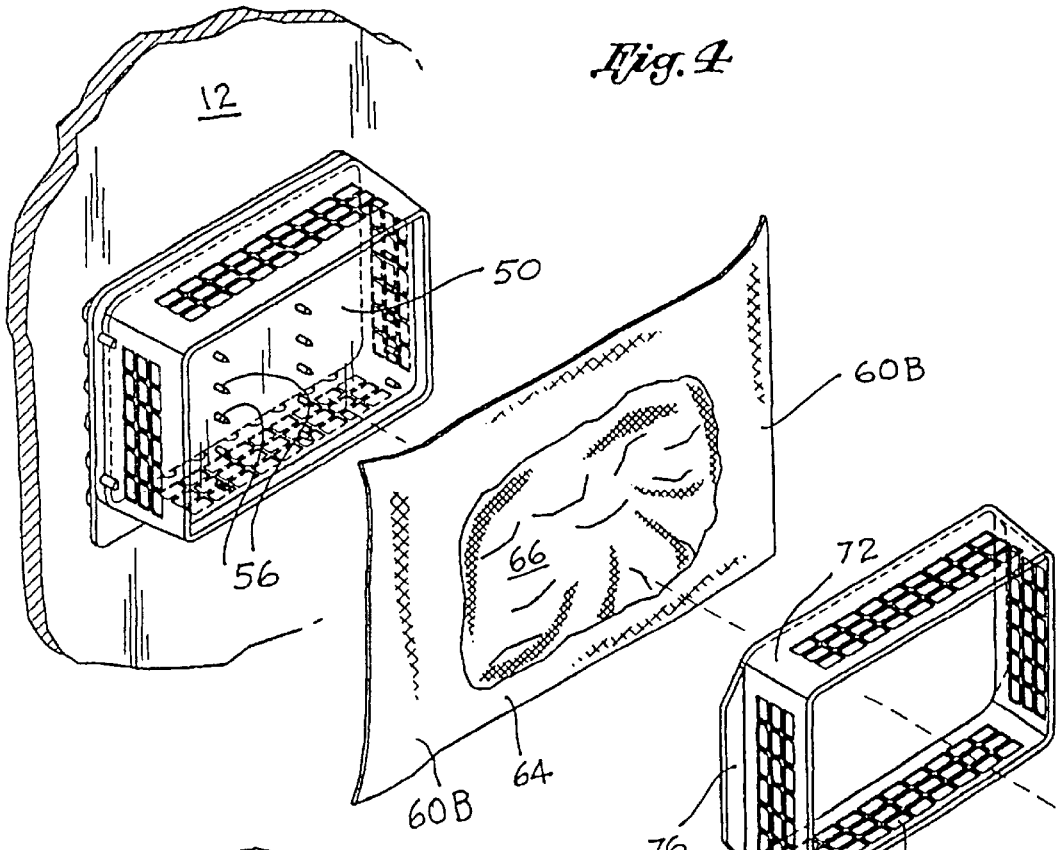
FIG. 4 is a perspective exploded view of a second embodiment of the present invention.

The scrubbing means mounting surface 50 provides a means for removably engaging a scrubbing means 56 on the scrubbing means mounting surface 50 for securement thereon. In a first embodiment, as shown in FIGS. 1–3, the scrubbing means mounting surface 50 is preferably formed by the base 52 of the mounting box 30 and an outwardly extending peripheral edge 54. In this first embodiment, the scrubbing means 60 is preferably a sponge 60A. The sponge 60A rests on the base 52 and the outwardly extending peripheral edge 54 at least partly surrounding an exterior side wall 62 of the sponge 60A for further securing the sponge 60A onto the scrubbing means mounting surface 50. The combination of the base 52 and the peripheral edge 54 firmly support the sponge 60A and hold it into position. The means for removably engaging the scrubbing means 56 preferably further includes a plurality of outwardly extending fingers 56. The outwardly extending fingers 56 penetrate the sponge 60A and further secure the sponge 60A onto the base 52. In its preferred embodiment, as shown in FIGS. 2 and 3, the outwardly extending fingers 56 are a plurality of spikes having barbed heads 56A. The spikes 56 are preferably plastic and are integral with the base 52. The barbed heads 56A pierce the sponge 60A and lodge within the sponge 60A, further securing the sponge 60A to the base 52. In another embodiment, as shown in FIG. 4, the spikes 56 do not have barbed heads. The scrubbing means 60 is thus supported in spaced relationship with respect to the wall surface 12 by the scrubbing means mounting box 30 so as to be in a position for convenient scrubbing of a person's skin when brought into contact with the sponge 60A.

Figure 5:
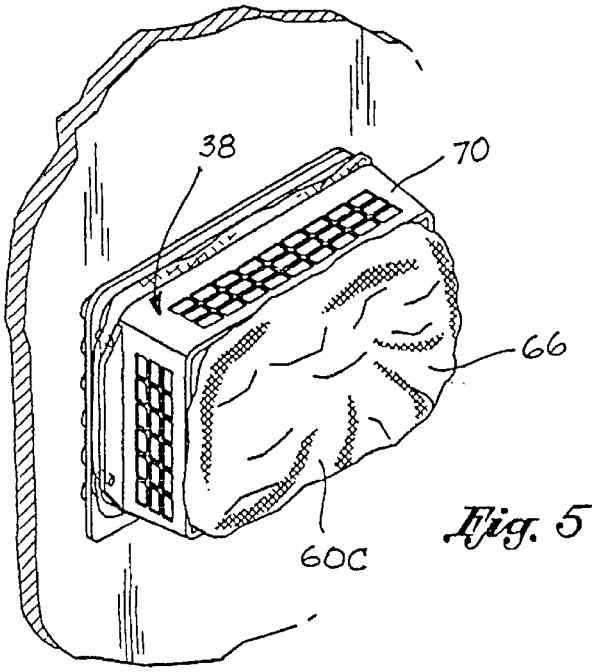
FIG. 5 is a perspective view thereof.

In a second embodiment, as shown in FIGS. 4 and 5, the apparatus 10 further includes a cover 70 and the mounting box supporting sidewall 32 provides an angled outer surface 38. The cover 70 provides a cover sidewall 72 corresponding to the supporting sidewall 32 of the mounting box 30. The cover sidewall 72 is positionable over the supporting sidewall 32 in frictional engagement therewith. The divergent supporting sidewall 32 of the mounting box 30 allows locking of the cover 70 over the mounting box 30. In this embodiment, the scrubbing means 60 is preferably a rectangular cloth large enough to cover the mounting box 30. The rectangular cloth 60B provides a flexible lateral apron portion 64. This apron portion 64 is engagable between the scrubbing means supporting sidewall 32 and the cover sidewall 72 for clamped holding of the apron portion 64 therebetween. When the apron portion 64 is thus clamped to the mounting box 30, a washing surface portion 66 of the scrubbing means 60 is thereby positionable for contact with the person's skin. The washing surface portion 66 is preferably formed by a plastic mesh scrubber 60C sewn into the middle of the rectangular cloth 60B. The plastic mesh scrubber 60C provides a rough texture which facilitates the washing of the user's back. An access hole (not shown) in the back of the rectangular cloth 60B allows the user to add a reservoir of soap to the scrubbing means 60. In its preferred embodiment, the scrubbing means 60 provides a sponge 60A which fits into the scrubbing means mounting surface 50 as described above. The rectangular cloth 60B is then positioned over the sponge 60A and locked into place by the cover 70, positioning the soap filled plastic mesh scrubber 60C into position as the washing surface portion 66. This embodiment provides a soapy, textured washing surface portion 66 which is pleasantly padded by the sponge 60A.

In the second embodiment, as shown in FIGS. 4 and 5, the cover sidewall 72 provides a cover aperture means 74 and the supporting sidewall 32 provides a supporting sidewall aperture means 40 for enabling water passage therethrough. Both the cover and supporting sidewall aperture means 74 and 40 are preferably a plurality of apertures through the cover sidewall 72 and the supporting sidewall 32 respectively. The supporting sidewall 32 preferably further provides a drain means 42 positioned for enabling water to flow out of the mounting box 30. As shown in FIG. 4, the drain means 42 is preferably a plurality of drainage holes through the lip 34 adjacent to the wall mounting plate 20. The cover sidewall 72 preferably includes a pair of handles 76 which allow the user to grasp the cover 70 and pull it off of the mounting box 30, releasing the scrubbing means 60. The scrubbing means 60 must be easily removable so that the users can easily change the scrubbing means 60, either for different textures or so different users can use their own scrubbing means 60.

It is clear from the above description that the method of the present invention is to, first mount the invention onto a shower wall, preferably by pressing the suction cups of the invention so as to achieve suction holding. A sponge or other cleaning device may then be press mounted onto the device and soap may optionally be applied to the sponge. Alternately, the sponge may be covered by a wash cloth which in turn would be held in place by the step of applying the cover ring for holding the cloth along its peripheral apron edges. Alternately, the cleaning device may be a loufa type of device or other similar items as conveniently selected by the user.

Figure 6:
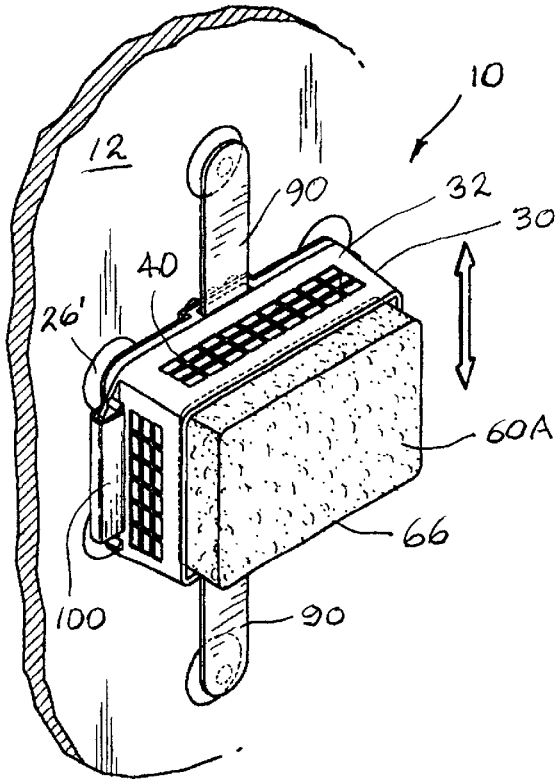
FIG. 6 is a perspective of a further embodiment of the present invention.
Figure 7:
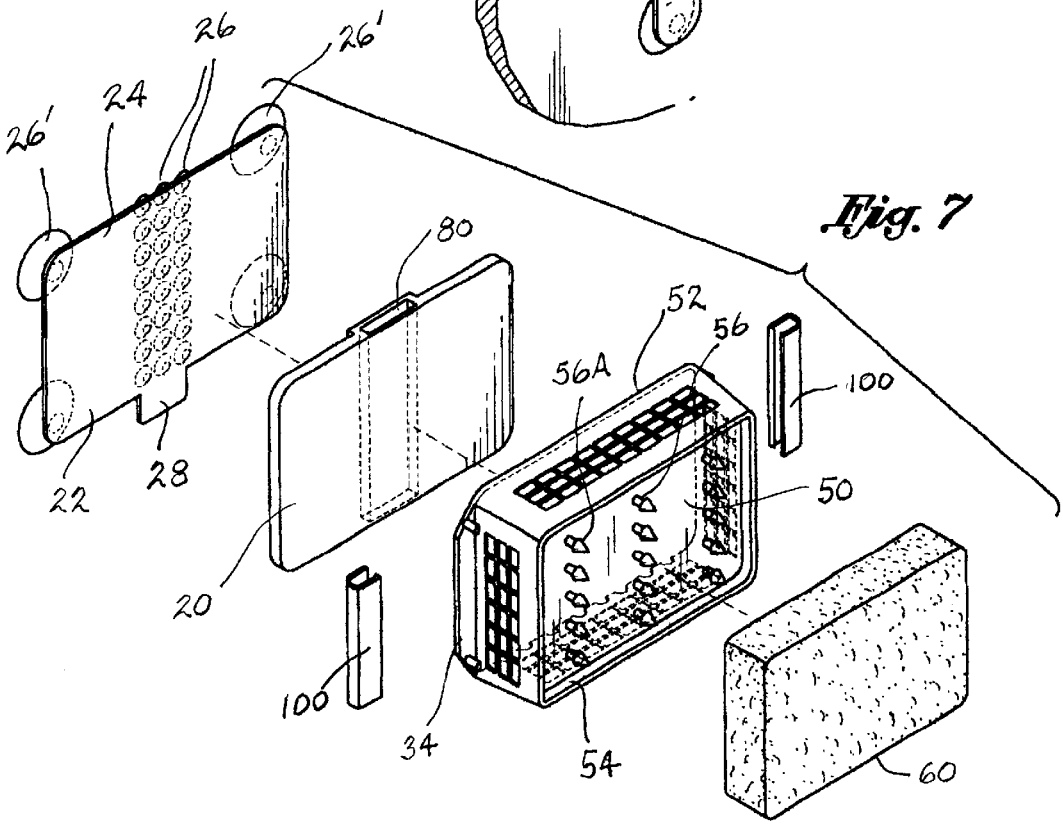
FIG. 7 is an exploded view of some of the elements shown in FIG. 6.

In a further embodiment of the present invention the wall mounted back-scrubbing and massaging apparatus 10 as described above is modified and adapted for being vertically adjustable to a desired height on the wall surface 12. This embodiment, shown in FIGS. 6–10 the wall mounting plate 20 provides the means for removably securing the wall mounting plate to the wall surface, preferably suction cups and a means for slidably engaging 80, such as the slot shown in FIG. 7, of a linear guide means 90 as shown in FIG. 6. A means for linear guide engagement (suction cups) provide for securing the linear guide means 90 to the wall surface 12 such that the wall mounting plate 20 may be moved to a desired vertical position along the linear guide means 90 as best seen in FIG. 6. The scrubbing means mounting box 30 provides the lip means 34 for fixing the scrubbing means mounting box 30 onto the wall mounting plate 20, but in this embodiment, by use of a clamping means 100 such as the U-clamps shown best in FIG. 7.

The scrubbing means mounting surface 50 is, as previously described, enabled for removably engaging the scrubbing means 60, such as a sponge, on the scrubbing means mounting surface for securement thereon. As described and shown previously, the scrubbing means 60 is supported in spaced relationship with respect to the wall surface 12 by the scrubbing means mounting box 30 and is positioned for facing outwardly from the wall surface 12 for convenient scrubbing of a person's skin thereagainst. Inventively, the means for removably securing the wall mounting plate 20 to the wall surface 12 is the suction cup means 26, preferably with four laterally spaced larger suction cups 26' and a series of smaller suction cups 26 medially positioned as previously described and best seen in FIG. 7 at the left. Further herein, the term "suction cup means" will refer to the smaller suction cups 26, the larger suction cups 26' or to both.

A handle means 110, preferably comprising a pair of laterally positioned opposing handles are slidably engaged with the mounting plate 20 and movable relative thereto from a first handle position P1 wherein said handle means 110 compresses the larger suction cups 26' for securement of the apparatus 10 to the wall surface 12. Notice that, as shown in FIG. 9, the handle means 110 comprises a gripping portion 110-G positioned to one side of the base plate 20 integrally joined with two handle arm portions 110-HA which extend into the base plate 20. The handle means 110 is movable to a second handle position P2, further away from the base plate 20 for releasing the compression on the larger suction cups 26' for realeasing the apparatus 10 from the wall surface 12.

Inventively, the handle means 110 is movably engaged within a slot means 21, preferably an internal guideway, of the base plate 20 for sliding therewithin, the handle means 110 further comprises a handle bias means 114, preferably a coil spring adapted for moving the handle means preferably toward the first handle position P1. The handle means 110 further comprises a suction cup bias means 116, a further coil spring, adapted for releasing pressure on the larger suction cups 26' for releasing the larger suction cups from the wall surface 12 when the handle means 110 is moved to position P2 as shown in FIG. 8. The suction cup bias means is fully biased when the handle means is moved to the first handle position and the handle bias means is fully biased when the handle means is moved to the second handle position. In order to press the larger suction cups 26' against the wall surface 12 the arm portions 110-HA provide an inclined surface 115 for pressing against a top end 26'-T of the cups 26' as shown in FIG. 10. In this manner, the larger suction cups 26' are able to be pressed into suction against wall surface 12 or released, by simply pulling or pushing on the handle means 10. When the apparatus has been positioned as desired the cups 26' are placed in suction and the other smaller cups (suction cup means 26) are then pressed into suction on the wall surface 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A wall mounted back-scrubbing and massaging apparatus comprising:

a wall mounting plate providing a means for removably securing the wall mounting plate to a wall surface;

a scrubbing means mounting box providing a supporting sidewall comprising a supporting sidewall aperture means encompassing each of four sides of the supporting sidewall so as to enable airflow through the mounting box and a lip for fixing the scrubbing means mounting box onto the wall mounting plate, and a scrubbing means mounting surface supported in spaced relationship apart from the wall mounting plate by the supporting sidewall, the mounting surface having a means for removably engaging a scrubbing means, the scrubbing means being supported in spaced relationship with respect to the wall surface by the scrubbing means mounting box so as to be in a position for convenient scrubbing of a person's skin when brought into contact with the scrubbing means.

2. The apparatus of claim 1 wherein the scrubbing means is a sponge and wherein the scrubbing means mounting surface provides an outwardly extending peripheral edge at least partly surrounding an exterior side wall of the sponge for further securing the sponge onto the scrubbing means mounting surface.

3. The apparatus of claim 2 wherein the means for removably engaging a scrubbing means includes a plurality of outwardly extending fingers positioned and configured for penetrating and securing the scrubbing means.

4. The apparatus of claim 1 wherein the mounting box supporting sidewall is angled relative to a normal to the wall mounting plate.

5. The apparatus of claim 4 further including a cover, the cover providing a cover sidewall corresponding to the supporting sidewall of the scrubbing means mounting box, the cover sidewall being positionable over the supporting sidewall in frictional engagement therewith.

6. The apparatus of claim 5 wherein the scrubbing means provides a flexible lateral apron portion thereof, engagable between the scrubbing means supporting sidewall and the cover sidewall for clamped holding of the apron portion therebetween, a washing surface portion of the scrubbing means being thereby positionable for contact with the person's skin.

7. The apparatus of claim 5 wherein the cover sidewall and the supporting sidewall each provide aperture means for enabling water passage therethrough.

8. The apparatus of claim 1 wherein the means for removably securing the wall mounting plate to a wall surface is a suction cup means.

9. The apparatus of claim 8 wherein the suction cup means provides a tab means extending laterally from the scrubbing means mounting box in a position for grasping the tab means for defeating the suction cup means by pulling the tab means away from the wall surface.

10. The apparatus of claim 1 wherein the supporting sidewall provides a drain means positioned for enabling water to flow out of the scrubbing means mounting box.

11. A wall mounted back-scrubbing and massaging apparatus comprising:

a wall mounting plate providing a means for removably securing the wall mounting plate to a wall surface and a means for slidably engaging a linear guide, the linear guide providing linear guide attachment means for securing the linear guide to the wall surface such that the wall mounting plate may be moved to a desired position along the linear guide;

a scrubbing means mounting box providing a lip means for fixing the scrubbing means mounting box onto the wall mounting plate with a clamping means, and a scrubbing means mounting surface having a means for removably engaging a scrubbing means on the scrubbing means mounting surface for securement thereon;

the scrubbing means being supported in spaced relationship with respect to the wall surface by the scrubbing means mounting box and positioned for facing outwardly from the wall surface for convenient scrubbing of a person's skin thereagainst.

12. The apparatus of claim 11 wherein the means for removably securing the wall mounting plate to a wall surface is a suction cup means and further comprising a handle means slidably engaged with the mounting plate and movable in relation thereto from a first handle position wherein said handle means compresses the suction cup means for securement of the apparatus to the wall surface, and wherein the handle means is movable to a second handle position for releasing the compression on the suction cup means for releasing the apparatus from the wall surface.

13. The apparatus of claim 12 wherein the handle means is movably engaged within a slot means for sliding therewithin, and further comprising a handle bias means adapted for moving the handle means to the first handle position.

14. The apparatus of claim 13 further comprising a suction cup bias means adapted for releasing pressure on the suction cup means for releasing the suction cup means from the wall surface.

15. The apparatus of claim 14 further wherein the suction cup bias means is fully biased when the handle means is moved to the first handle position and the handle bias means is fully biased when the handle means is moved to the second handle position.

* * * * *